US009327159B1

(12) United States Patent
Medina

(10) Patent No.: US 9,327,159 B1
(45) Date of Patent: May 3, 2016

(54) CONVERTIBLE VARIABLE WEIGHT EXERCISE SYSTEM

(71) Applicant: Richard Anthony Medina, Bullhead City, AZ (US)

(72) Inventor: Richard Anthony Medina, Bullhead City, AZ (US)

( * ) Notice: Subject to any disclaimer, the term of this patent is extended or adjusted under 35 U.S.C. 154(b) by 0 days.

(21) Appl. No.: 14/477,069

(22) Filed: Sep. 4, 2014

Related U.S. Application Data

(60) Provisional application No. 61/922,496, filed on Dec. 31, 2013.

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC ..... A63B 21/00; A63B 21/0004; A63B 21/00043; A63B 21/072; A63B 21/0724; A63B 21/0726; A63B 21/0728; A63B 21/00065; A63B 21/00058; A63B 21/0013; A63B 11/00; A63B 13/00; A63B 15/00; A63B 21/06; A63B 21/0601; A63B 21/0605; A63B 21/065; A63B 21/075; A63B 21/00069; A63B 21/00079
USPC ..... 482/92–93, 104, 106–108; 42/59, 61, 42/62
See application file for complete search history.

(56) References Cited

U.S. PATENT DOCUMENTS 4,384,714 A * 5/1983 Kimura ..... A63B 21/065 482/105
5,464,379 A * 11/1995 Zarecky ..... A63B 21/0728 482/106
6,120,420 A * 9/2000 Pearson ..... A63B 21/072 482/106
6,315,699 B1 * 11/2001 Romero ..... A63B 21/0728 482/107
7,001,310 B1 * 2/2006 Brice ..... A63B 21/075 482/106
7,819,786 B1 * 10/2010 Cao ..... A63B 21/0726 482/106

(Continued)

FOREIGN PATENT DOCUMENTS

GB 2413288 A * 10/2005 ..... A63B 21/072

*Primary Examiner* — Loan H Thanh
*Assistant Examiner* — Andrew S Lo
(74) *Attorney, Agent, or Firm* — Plager Schack LLP

(57) ABSTRACT

The embodiments herein relate to a weight system enabling a user to configure the system for the performance of various exercises. The invention comprises a multiplicity of generally cylindrical weights which are inserted into weight receiving bores equally spaced around a central bore of a generally cylindrical body with a first and second face. A post with at least one end is configured to releasably engage the central bore on the first face of the body. A first collar releasably engages the first end of the post proximal to the body to prevent the weights from exiting the weight receiving bore to form a kettlebell. In an alternate embodiment, the second end of the post is configured to releasably engage a central bore of a second generally cylindrical body which mirrors the configuration of the first generally cylindrical body to modify the kettlebell configuration into a dumbbell configuration.

7 Claims, 4 Drawing Sheets

(56) References Cited

U.S. PATENT DOCUMENTS 8,517,895 B2 * 8/2013 Shalev ..... A61H 7/001 482/1
2003/0096683 A1 * 5/2003 Fenelon ..... A63B 21/075 482/107
2004/0067826 A1 * 4/2004 Elledge ..... A63B 21/0601 482/106
2004/0072662 A1 * 4/2004 Landfair ..... A63B 21/0605 482/106
2004/0162199 A1 * 8/2004 Connelly ..... A63B 21/0728 482/107
2005/0065003 A1 * 3/2005 Klotzki ..... A63B 21/072 482/107
2010/0048362 A1 * 2/2010 Liford ..... A63B 21/072 482/93
2010/0075816 A1 * 3/2010 Anderson ..... A63B 21/0728 482/107
2011/0263392 A1 * 10/2011 Yu ..... A63B 21/075 482/93
2012/0053024 A1 * 3/2012 Mendoza ..... A63B 21/072 482/106
2012/0115689 A1 * 5/2012 Dalebout ..... A63B 21/0726 482/107
2013/0231225 A1 * 9/2013 Shozda ..... A63B 21/0724 482/108
2014/0031177 A1 * 1/2014 Wang ..... A63B 21/075 482/107
2014/0057764 A1 * 2/2014 Klukas ..... A63B 15/00 482/109

* cited by examiner

CONVERTIBLE VARIABLE WEIGHT EXERCISE SYSTEM

RELATED APPLICATION

This application claims priority to provisional patent application U.S. Ser. No. 61/922,496 filed on Dec. 31, 2013, the entire contents of which is herein incorporated by reference.

BACKGROUND

The embodiments herein relate generally to a weight resistance system which enables a user to configure the system for the performance of various exercises as a kettle bell and a dumbbell.

SUMMARY

The invention disclosed herein is a convertible, variable-weight, exercise system configured to permit a user to engage in a variety of exercises. A body having a plurality of openings each configured to house a weight which are each configured to fit within one opening of the body. A handle is configured to be held by the user and configured to the body. A collar is configured to at least partially obstruct the plurality of openings, whereby any weights placed in the openings would be prevented from exiting the opening. In one embodiment of the disclosed invention the collar is secured to the handle, and the collar partially obstructs the plurality of openings when the handle is secured to the body. In an alternate embodiment of the disclosed invention, the collar is secured to the body. The handle of the invention can be configured to connect to a second body. To protect the weights against wear and tear, the weights may be coated with protective coating chosen from a group consisting of urethane resin, powder coating or zinc plating.

BRIEF DESCRIPTION OF THE FIGURES

The detailed description of some embodiments of the invention will be is made below with reference to the accompanying figures, wherein like numerals represent corresponding parts of the figures.

DETAILED DESCRIPTION OF CERTAIN EMBODIMENTS

Figure 1:
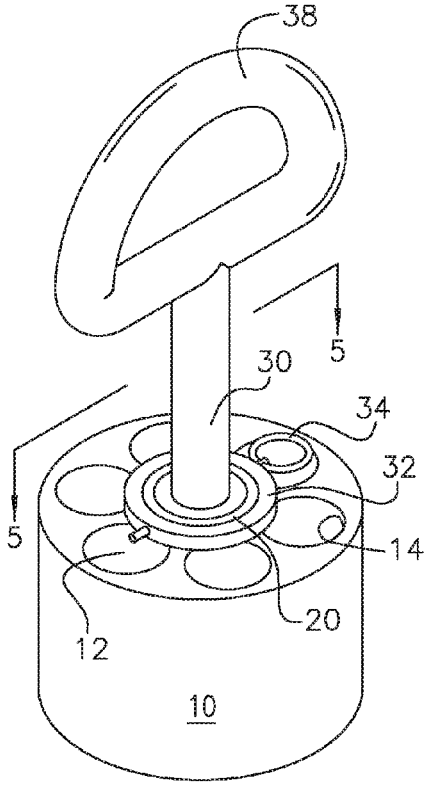
FIG. 1 shows a perspective view of one embodiment of the present invention.
Figure 2:
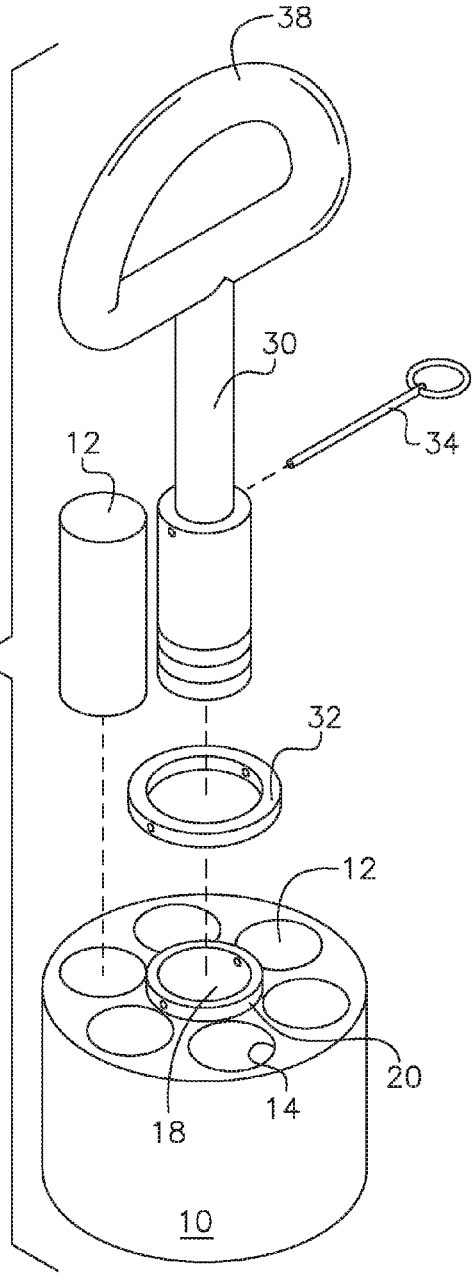
FIG. 2 shows an exploded view of one embodiment of the present invention.

By way of example, and referring to FIGS. 1 and 2, one configuration of the present system forms a kettle bell.

Figure 3:
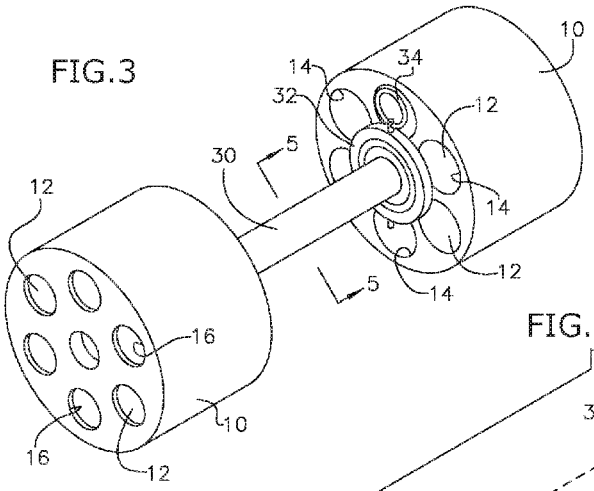
FIG. 3 shows a perspective view of another embodiment of the present invention.
Figure 4:
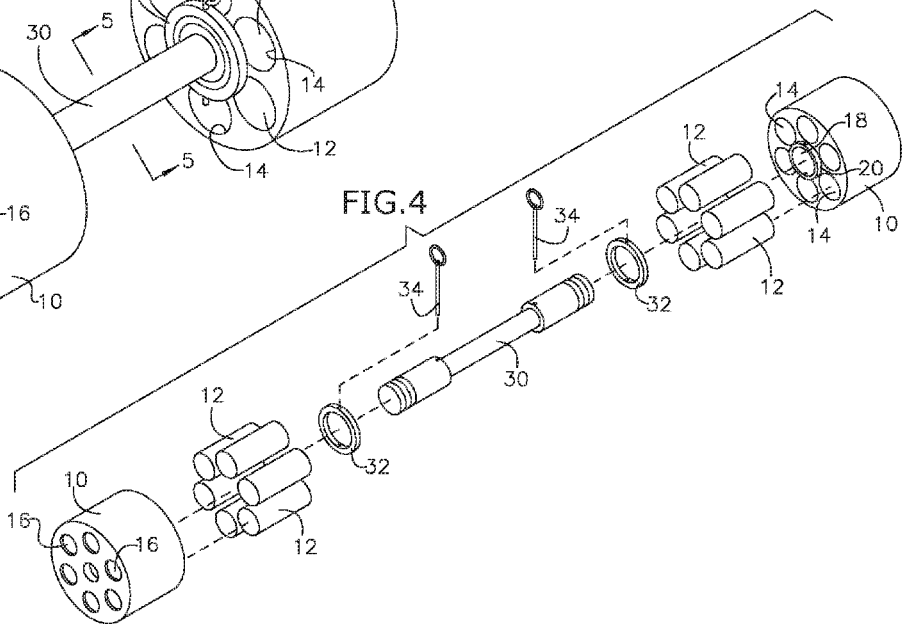
FIG. 4 shows an exploded view of one embodiment of the present invention.
Figure 5:
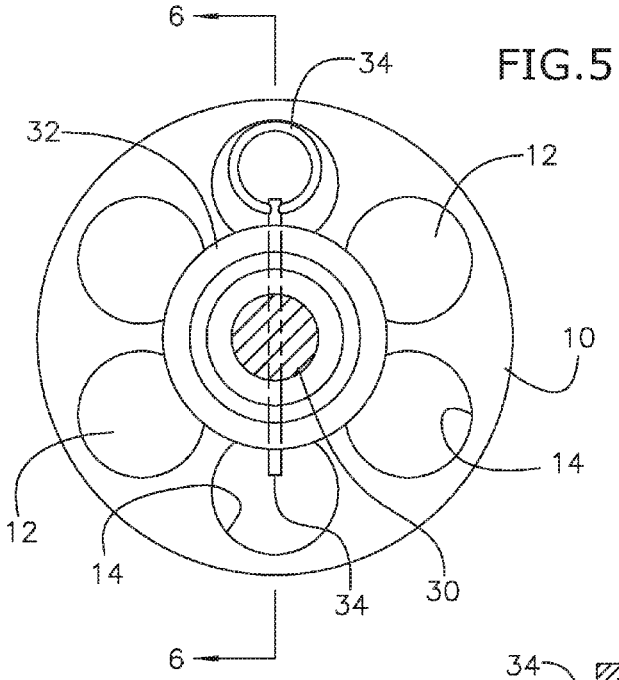
FIG. 5 shows a sectional view of one embodiment of the invention taken along line 5-5 in FIGS. 1 and 3.
Figure 6:
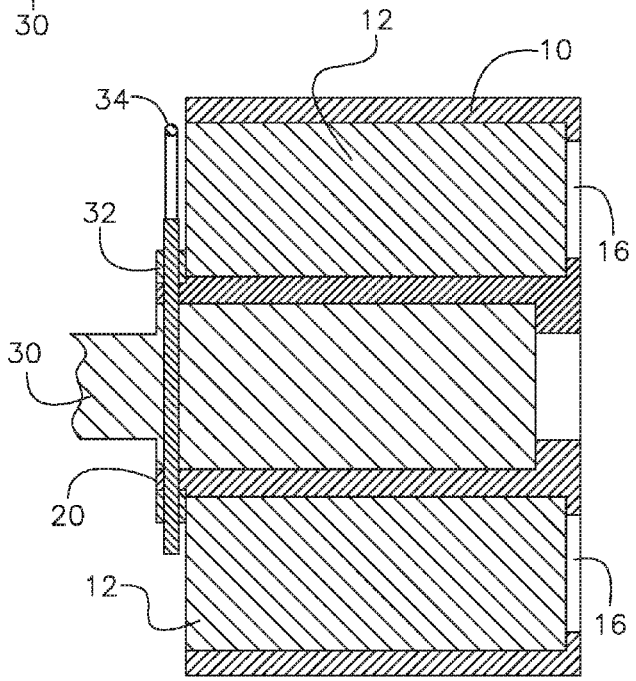
FIG. 6 is a sectional view of one embodiment of the invention taken along line 6-6 in FIG. 5.
Figure 7:
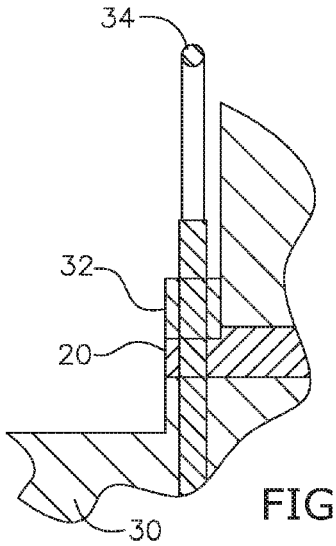
FIG. 7 is close-up of the pin assembly of one of the embodiments.

Another configuration of the present system forms a dumb bell as depicted in FIGS. 3 and 4.

Referring to FIGS. 1 and 2, the kettlebell configuration comprises a multiplicity of generally cylindrical weights 12 with a predefined outer diameter for insertion into weight receiving bores 14 located in a generally cylindrical body 10. The body may also comprise other geometric shapes such as a square, rectangle, or triangle. To protect the weights against wear and tear, and other abuse, it is recommended that the weights are coated with a durable resin coating such as urethane, powder coating or zinc plating. The resin coating serves the added benefit of creating friction to prevent easy dislodgment of the weights from the body after insertion. It is preferred that each weight is 2.5 pounds including the protective resin coating.

The generally cylindrical body 10 comprises a first face, a second face, a central bore 18 and, a multiplicity of weight receiving bores 14 equally spaced around the central bore 18. The weight receiving bores 14 comprise a first end located on the first face of the cylindrical body with an inner diameter sufficient to receive and retain the weights therein, and a second end 16 on the second face with a reduced inner diameter to prevent the weight from exiting the second end 16 of the bore. It is preferred that each body 10 weighs 5 pounds when the weights 12 are absent from the body.

Figure 8:
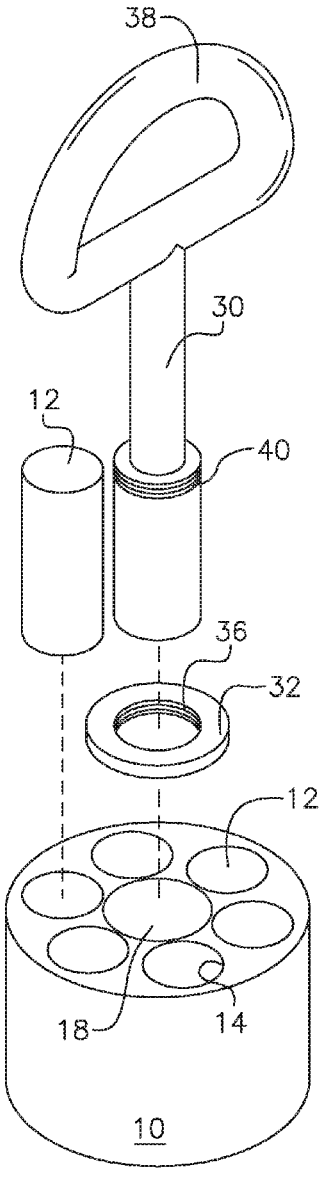
FIG. 8 is a perspective view of a first embodiment of the collar engaging the post proximal to first face of the body.
Figure 9:
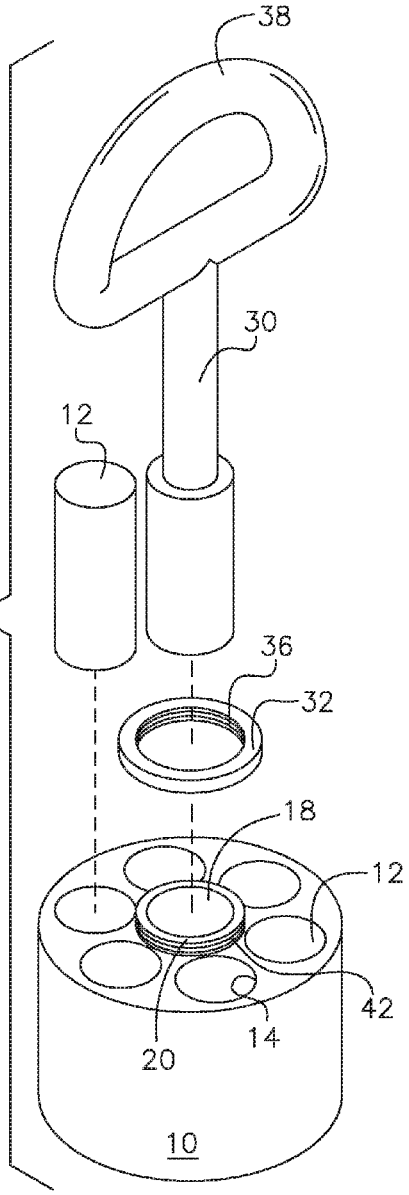
FIG. 9 is a perspective view of an alternate embodiment of the collar engaging the post proximal to first face of the body.

In one embodiment, as depicted in FIG. 8, a collar 32 releasably engages the first end of the post 30 proximal to the first face of the body 10. In an alternate embodiment, as depicted in FIG. 9, the collar 32 releasably engages a lip 20 extending radially from the central bore 18. In this alternate embodiment, FIG. 9, the collar 32 is secured to the lip 20 using either complementary threads (40, 42) on the inner diameter of the collar 32 and the lip 20 of the body 10, or, alternatively, a pin 34, as depicted in FIGS. 1-7, secures the collar 32 to the lip 20. Regardless of the mechanism to engage the collar proximal to the first face of the body, the collar 32 is of sufficient diameter to partially obstruct the weight receiving bores 14 to prevent the weight 12 from escaping from the weight receiving bore 14.

In a first embodiment of the post 30, at least one end of post 30 is configured to releasably engage the central bore on the first face of the body. Releasable engagement of the post 30 to the body 10 may be accomplished with complementary threads on the outer diameter of the post 30 and the inner diameter of the central bore 18. Other means of releasably attaching the post 30 to the body 10 are readily known to persons of ordinary skill in the art. The opposite end of the post 30 is configured to form a loop to permit a user to grip the apparatus. The loop may be configured in any number of geometric shapes such as a triangle, a square, a circle or an oval as depicted in FIGS. 1 and 2. Alternatively, the second end of the post 30 may remain straight. It is preferred that the handle weights 5 pounds absent the attachment of any other components.

In an alternate embodiment of the post 30, both ends of the post 30 are configured to releasably engage the central bore 18 of a first body 10 and second body 10 to form a dumbbell as depicted in FIGS. 3 and 4. The second body 10 is configured to identically resemble the first body 10. The second body comprises a first face, a second face, a central bore 18 and, a multiplicity of weight receiving bores 14 equally spaced around the central bore. The weight receiving bores 14 comprise a first end on the first face of the cylindrical body with an inner diameter sufficient to receive and retain the weights 12 therein, and a second end 16 on the second face with a reduced inner diameter to prevent the weight from exiting the second end 16 of the weight receiving bore 14. The weights within the body are secured by a second collar 32 proximal to the first face of the second body. The second collar 32 has a radius sufficient to at least partially block the weight receiving bores 14 to prevent the weights 12 from exiting the weight receiving bores.

The cylindrical bodies 10, handle 30, and weights 12 are preferably manufactured from billet aluminum or steel using a machine process, or urethane molding process. The weights are preferably coated with a urethane, powder coating or zinc plating.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A convertible, variable-weight, exercise system configured to permit a user to engage in a variety of exercises, the system comprising:

a body comprising a central bore and a plurality of openings each configured to house a weight;

a plurality of weights wherein each weight is configured to fit within one opening of the body;

a post configured to mate with the central bore of the body and be held by the user; and a collar configured to contact and directly fasten to the post in direct contact with the body to at least partially obstruct the plurality of openings whereby any weights placed in the openings would be prevented from exiting the body.

2. The system of claim 1 wherein the post is further configured to mate with a central bore of a second body.

3. The system of claim 1 wherein a complementary thread is located on an inner diameter of the collar and on an outer diameter of the post to secure the collar to the post to prevent the weights from exiting the body.

4. The system of claim 1 wherein the collar is secured to the post with a locking pin passing through an aperture in the collar and an aligned aperture in the post to prevent the weights from exiting the body.

5. The system of claim 1 wherein a complementary thread is located on an outer diameter of a lip and on an inner diameter of the collar to secure the collar to the lip to prevent the weights from exiting the body.

6. The system of claim 1 wherein the weights are coated with protective coating chosen from a group consisting of urethane resin, powder coating, and zinc plating to protect the weights against wear and tear.

7. The system of claim 1 wherein the plurality of openings and the weights comprise generally cylindrical shapes.

* * * * *